US011776341B2

(12) United States Patent
Kuenzi et al.

(10) Patent No.: US 11,776,341 B2
(45) Date of Patent: Oct. 3, 2023

(54) INTRUDER DETECTION THROUGH LOCK REPORTING

(71) Applicant: Carrier Corporation, Palm Beach Gardens, FL (US)

(72) Inventors: Adam Kuenzi, Silverton, OR (US); Steve Switzer, Atlanta, GA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,104

(22) PCT Filed: Sep. 10, 2020

(86) PCT No.: PCT/US2020/050135
§ 371 (c)(1),
(2) Date: Dec. 8, 2020

(87) PCT Pub. No.: WO2021/050684
PCT Pub. Date: Mar. 18, 2021

(65) Prior Publication Data

US 2022/0351563 A1 Nov. 3, 2022

Related U.S. Application Data

(60) Provisional application No. 62/898,793, filed on Sep. 11, 2019.

(51) Int. Cl.
*G07C 9/27* (2020.01)
*G07C 9/28* (2020.01)

(52) U.S. Cl.
CPC ..... *G07C 9/27* (2020.01); *G07C 9/28* (2020.01)

(58) Field of Classification Search
CPC ..... G07C 9/27; G07C 9/28; G07C 2209/62; G07C 9/00571; G07C 9/00174
See application file for complete search history.

(56) References Cited

U.S. PATENT DOCUMENTS

| | | | |
|---|---|---|---|
| 5,422,634 | A | 6/1995 | Okubo |
| 5,749,253 | A | 5/1998 | Glick et al. |
| 5,850,753 | A | 12/1998 | Varma |
| 6,422,463 | B1 | 7/2002 | Flink |
| 6,981,142 | B1 | 12/2005 | Gulcu |
| 7,019,614 | B2 | 3/2006 | Lavelle et al. |
| 7,138,732 | B2 | 11/2006 | Biskup, Sr. et al. |

(Continued)

FOREIGN PATENT DOCUMENTS

| | | | |
|---|---|---|---|
| CN | 106408710 | A | 2/2017 |
| CN | 107516118 | A | 12/2017 |

(Continued)

OTHER PUBLICATIONS

International Search Report and Written Opinion for Application No. PCT/US2020/050135; dated Dec. 15, 2020; 14 Pages.

*Primary Examiner* — Nabil H Syed
(74) *Attorney, Agent, or Firm* — CANTOR COLBURN LLP

(57) ABSTRACT

A method for reporting activity at a lock includes detecting an access attempt at the lock in response to a credential presented at the lock; determining if an event is to be generated in response to the access attempt; upon generation of the event, determining if an alert is to be generated in response to the event.

15 Claims, 4 Drawing Sheets

(56) References Cited

U.S. PATENT DOCUMENTS

| | | | | |
|---|---|---|---|---|
| 7,170,998 | B2 | 1/2007 | McLintock et al. | |
| 7,236,085 | B1 | 6/2007 | Aronson et al. | |
| 7,600,129 | B2 | 10/2009 | Libin et al. | |
| 8,015,597 | B2 | 9/2011 | Libin et al. | |
| 8,253,533 | B2 | 8/2012 | Jones | |
| 8,261,319 | B2 | 9/2012 | Libin et al. | |
| 8,665,064 | B1 | 3/2014 | Rodenbeck et al. | |
| 9,384,611 | B2 | 7/2016 | Dyk et al. | |
| 9,449,443 | B2 | 9/2016 | Libin et al. | |
| 9,805,528 | B1 | 10/2017 | Toepke et al. | |
| 9,836,898 | B2 | 12/2017 | Huang et al. | |
| 9,953,474 | B2 | 4/2018 | Mohan et al. | |
| 9,990,786 | B1 * | 6/2018 | Ziraknejad | G06F 21/45 |
| 2012/0083305 | A1 | 4/2012 | Alexander et al. | |
| 2013/0127593 | A1 | 5/2013 | Kuenzi et al. | |
| 2013/0342314 | A1 | 12/2013 | Chen et al. | |
| 2015/0350405 | A1 | 12/2015 | Rettig et al. | |
| 2017/0043881 | A1 * | 2/2017 | Fleck | B64D 45/0053 |
| 2018/0067593 | A1 | 3/2018 | Tiwari et al. | |
| 2018/0247070 | A1 | 8/2018 | Evans | |
| 2019/0141504 | A1 | 5/2019 | Ahearn et al. | |
| 2019/0244492 | A1 * | 8/2019 | Horgan | G08B 13/08 |
| 2020/0135006 | A1 * | 4/2020 | Costello | G06F 16/358 |

FOREIGN PATENT DOCUMENTS

| | | | |
|---|---|---|---|
| CN | 105761343 | B | 3/2018 |
| CN | 109636988 | A | 4/2019 |
| DE | 2917039 | A1 | 11/1980 |
| DE | 102016103366 | A1 | 8/2017 |
| EP | 2442282 | B1 | 5/2014 |

* cited by examiner

INTRUDER DETECTION THROUGH LOCK REPORTING

BACKGROUND

The subject matter disclosed herein generally relates to the field of access control systems, and more particularly to detecting an intruder in response to lock activity.

Existing access controls may allow a person to unlock one or more doors (e.g., in a hotel) via a credential in the form of a key card and/or a mobile device. If a hotel guest loses their key card, a dishonest person may find the key card and then attempt to search the hotel looking for a room that the key card will open. This is known as a "wandering intruder" situation.

SUMMARY

According to one embodiment, a method for reporting activity at a lock includes detecting an access attempt at the lock in response to a credential presented at the lock;

determining if an event is to be generated in response to the access attempt; upon generation of the event, determining if an alert is to be generated in response to the event.

In addition to one or more of the features described above, or as an alternative, further embodiments may include wherein determining if the event is to be generated comprises not generating the event in response to the access attempt opening the lock.

In addition to one or more of the features described above, or as an alternative, further embodiments may include wherein determining if the event is to be generated comprises not generating the event in response to the access attempt not opening the lock and the credential previously being authorized to open the lock.

In addition to one or more of the features described above, or as an alternative, further embodiments may include wherein determining if the event is to be generated comprises generating the event in response to the access attempt not opening the lock and the credential not previously being authorized to open the lock.

In addition to one or more of the features described above, or as an alternative, further embodiments may include wherein determining if the alert is to be generated in response to the event comprises applying one or more event factors to the event.

In addition to one or more of the features described above, or as an alternative, further embodiments may include wherein the one or more event factors comprises an event threshold factor, wherein the alert is generated in response to a number of events exceeding the event threshold factor.

In addition to one or more of the features described above, or as an alternative, further embodiments may include wherein the one or more event factors comprises an event sequence factor, wherein the alert is generated in response to a number of events occurring in a sequence.

In addition to one or more of the features described above, or as an alternative, further embodiments may include wherein the one or more event factors comprises an event per time factor, wherein the alert is generated in response to a number of events exceeding the event per time factor.

In addition to one or more of the features described above, or as an alternative, further embodiments may include wherein the one or more event factors comprises an event location factor, wherein the alert is generated in response to a location of the event with respect to the event location factor.

In addition to one or more of the features described above, or as an alternative, further embodiments may include wherein the one or more event factors comprises a feedback factor, wherein the alert is generated in response to the feedback factor.

In addition to one or more of the features described above, or as an alternative, further embodiments may include upon determining that the alert is to be generated, transmitting the alert to a monitoring system.

In addition to one or more of the features described above, or as an alternative, further embodiments may include prioritizing alerts prior to transmission to the monitoring system.

In addition to one or more of the features described above, or as an alternative, further embodiments may include filtering alerts prior to transmission to the monitoring system.

According to another embodiment, a system includes a lock configured to detect an access attempt at the lock in response to a credential presented at the lock; the lock configured to determine if an event is to be generated in response to the access attempt; a lock server in communication with the lock; upon generation of the event, the lock server configured to determine if an alert is to be generated in response to the event.

According to another embodiment, a computer program product for reporting activity at a lock, the computer program product comprising a non-transitory computer readable storage medium having program instructions embodied therewith, the program instructions executable by a processor to cause the processor to implement operations including detecting an access attempt at the lock in response to a credential presented at the lock; determining if an event is to be generated in response to the access attempt; upon generation of the event, determining if an alert is to be generated in response to the event.

Technical effects of embodiments of the present disclosure include the ability to collect events generated at locks and determine if an alert should be created in response to the events.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way.

DETAILED DESCRIPTION

A detailed description of one or more embodiments are presented herein by way of exemplification and not limitation with reference to the Figures.

Figure 1:
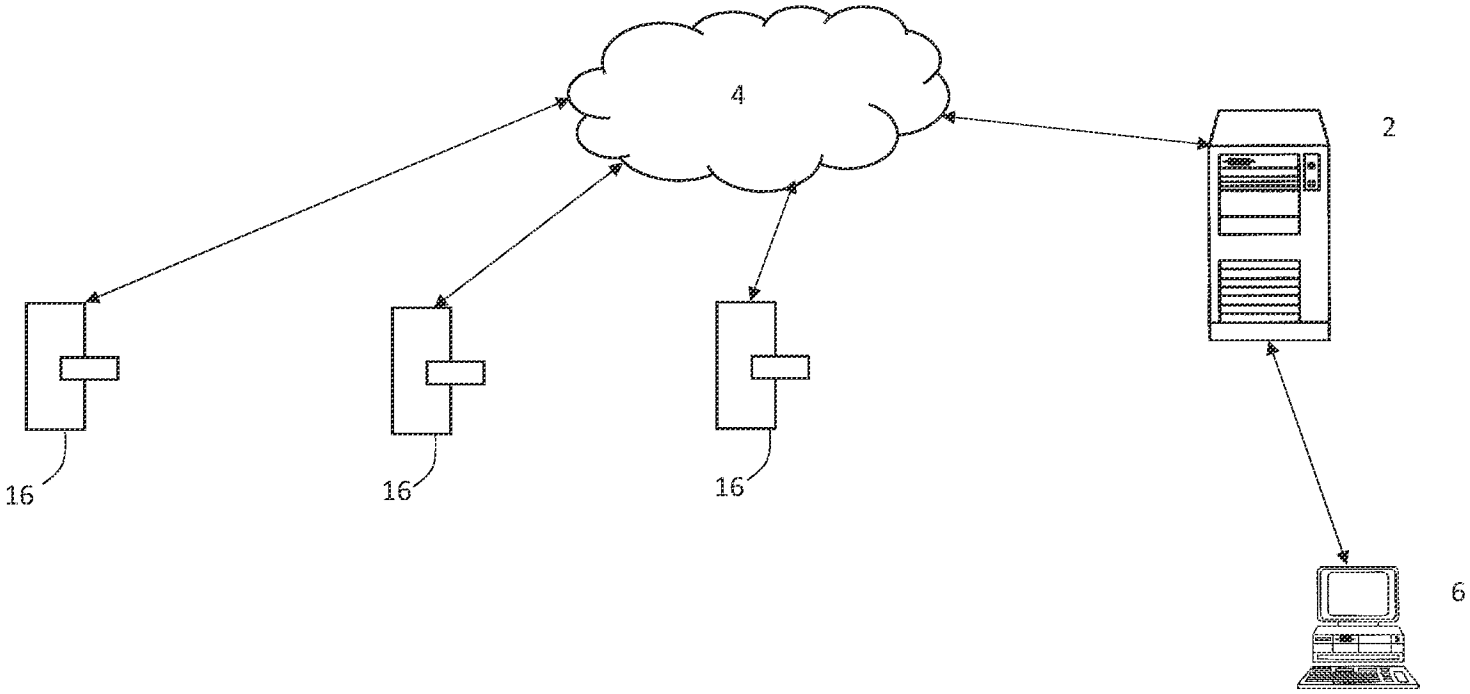
FIG. 1 depicts an example environment in which embodiments of the disclosure may be employed.

FIG. 1 depicts an example environment in which embodiments of the disclosure may be employed. FIG. 1 depicts a plurality of locks 16 in communication with a lock server 2 over a network 4. The locks 16 may correspond to door locks in a hotel or other location having restricted access such as a university, hospital, office building, etc. The network 4 may be implemented using wired and/or wireless protocols such as wired LAN, wireless LAN, Zigbee, Wi-Fi, Bluetooth, etc., and combinations thereof. The lock server 2 may be implemented using any type of computation or computer device capable of performing the functions described herein, including, without limitation, a computer, a server, a workstation, a desktop computer, a laptop computer, a notebook computer, a tablet computer, a mobile computing device, a wearable computing device, a network appliance, a web appliance, a distributed computing system (e.g., cloud computing), a processor-based system, and/or a consumer electronic device.

The lock server 2 communicates with a monitoring system 6, either through a direct connection or over the network 4. In the example of a hotel environment, the monitoring system 6 may be a terminal located at the front desk. The monitoring system 6 may be implemented using any type of computation or computer device capable of performing the functions described herein, including, without limitation, a computer, a server, a workstation, a desktop computer, a laptop computer, a notebook computer, a tablet computer, a mobile computing device, a wearable computing device, a network appliance, a web appliance, a processor-based system, and/or a consumer electronic device.

Figure 2:
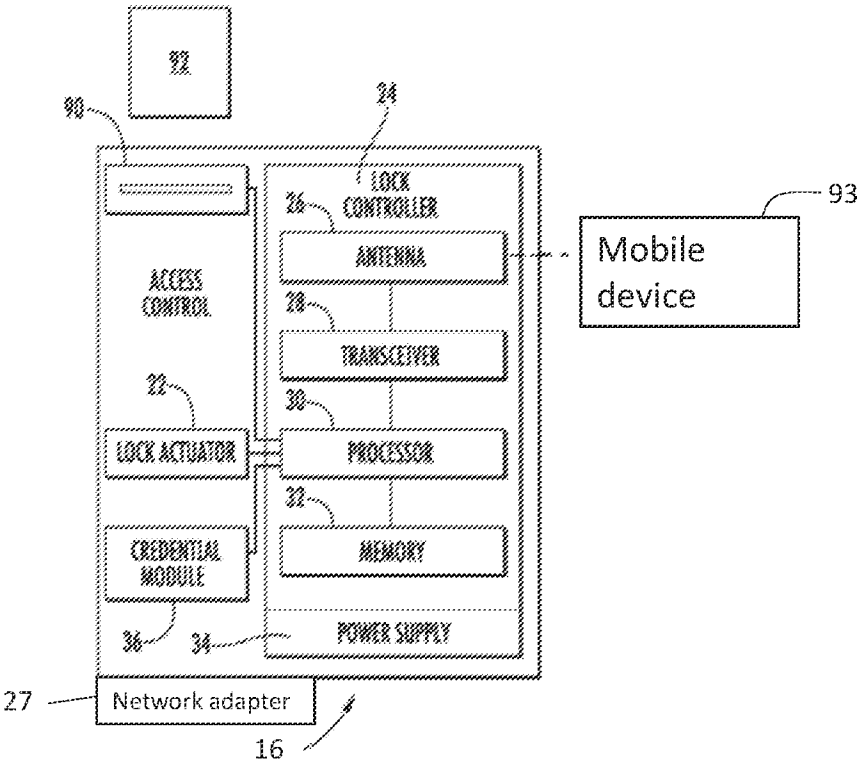
FIG. 2 depicts a lock in an example embodiment.

FIG. 2 depicts a lock 16 in an example embodiment. The lock 16 generally includes a lock actuator 22, a lock controller 24, a lock antenna 26, a lock transceiver 28, a lock processor 30, a lock memory 32, a lock power supply 34, a lock card reader 90 and a credential module 36. The lock 16 may receive a credential from the card reader 90 when the credential is stored on a key card 92, or from the antenna 26 when the credential is stored on a mobile device 93 (e.g., mobile phone, smart watch, FOB device, etc.). The lock 16 is responsive to the credential, such that if the credential is valid (i.e., not expired) and the credential is permitted (i.e., this person can open this lock) then the lock 16 is responsive to open. Otherwise, the lock 16 will not open and will provide an error indication (e.g., flash a RED led). Upon receiving and authenticating an appropriate credential, the lock controller 24 commands the lock actuator 22 to lock or unlock a mechanical or electronic lock. The lock controller 24 and the lock actuator 22 may be parts of a single electronic or electromechanical lock unit, or may be components sold or installed separately.

The lock transceiver 28 is configured for transmitting and receiving data to and from at least the lock antenna 26. The lock transceiver 28 may, for instance, be a near field communication (NFC), Bluetooth, infrared, Zigbee, or Wi-Fi transceiver, or another appropriate wireless transceiver. The lock processor 30 and the lock memory 32 are, respectively, data processing, and storage devices. The lock processor 30 may, for instance, be a microprocessor that can process instructions to validate credentials and determine the access rights contained in the credentials or to pass messages from the transceiver 28 to the credential module 36 and to receive a response indication back from the credential module 36. The lock memory 32 may be RAM, EEPROM, or other storage medium where the lock processor 30 can read and write data including but not limited to lock configuration options. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt).

A network adapter 27 provides for bidirectional communication between the lock 16 and the lock server 2 over the network 4. Each lock 16 is associated with a unique identifier, which may be stored in the memory 32. Each lock 16 also includes a lock credential, which may be stored in the memory 32, and used by the credential module 36 to grant or deny access to the lock 16. As such, the lock server 2 can communicate with an individual lock 16, and read, write or update the lock credential associated with a respective lock 16.

In operation, each lock 16 may generate an event upon an access attempt at the lock 16. Some events may indicate successful unlocking of the lock 16. Other events may indicate an error, e.g., the lock 16 attempted to read a credential and failed or the lock 16 read a credential and it was not authorized, etc. The event(s) are sent to the lock server 2, which then determines if an alert is warranted. The alert may then be sent to the monitoring system 6.

Figure 3:
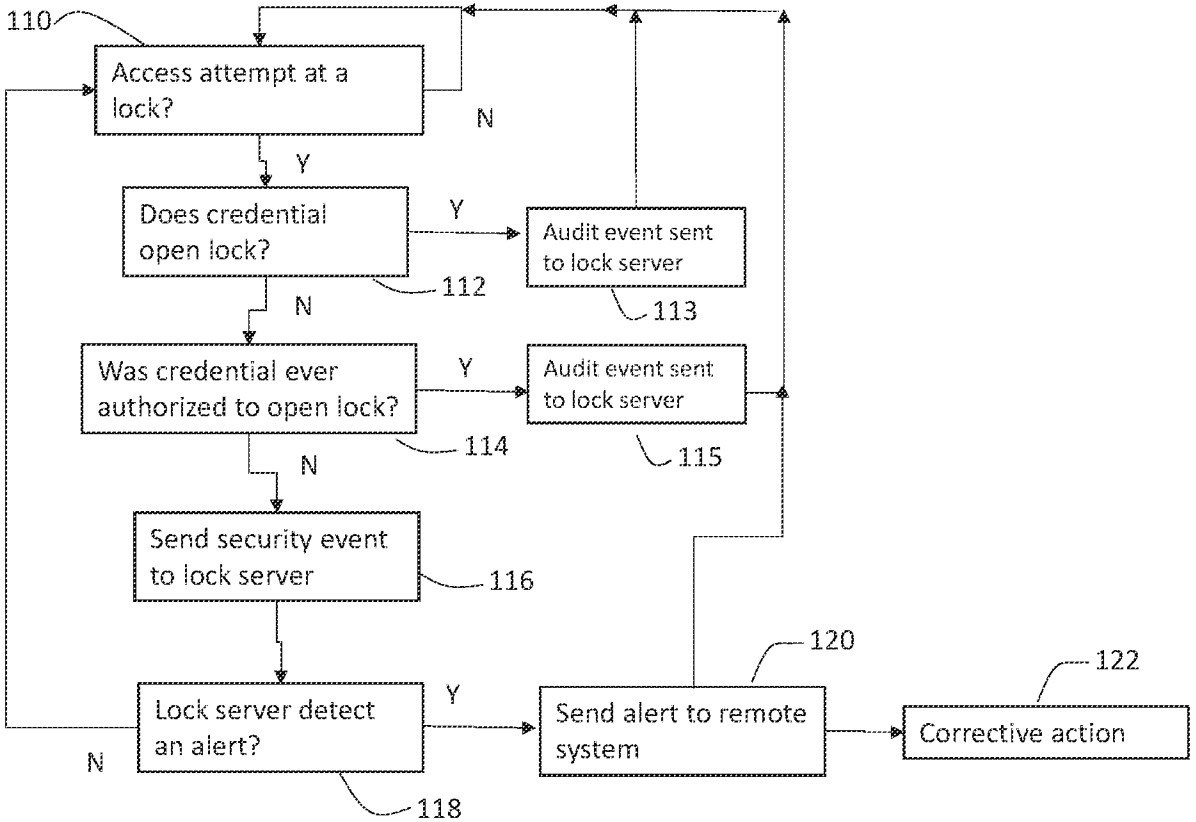
FIG. 3 depicts a process of generating events in an example embodiment.

FIG. 3 depicts a process of generating an event at a lock 16 in an example embodiment. The process may be executed by the processor 30 in the lock 16 and the lock server 2. It is understood that each lock 16 executes steps of FIG. 3 and multiple events may be sent to the lock server 2 for a plurality of locks 16. At 110, the processor 30 determines if an access attempt has been received at the lock 16. An access attempt may be initiated by presentation of a credential (e.g., either a keycard 92 or a credential on a mobile device 93) at the lock 16. If no access attempt is received, the process waits at 110.

When an access attempt is received at 110, flow proceeds to 112 where the processor 30 determines if the credential opens the lock 16. This may be performed by providing the credential to the credential module 36 which compare the credential to the lock credential. If the credential opens the lock 16 (e.g., access is granted), at 113 the lock 16 sends an audit event to the lock server 2 indicating that the credential opened the lock 16. An audit event identifies an access attempt that does not pose a security threat. The process returns to 110. If at 112, the credential does not open the lock 16 (e.g., access is denied), flow proceeds to 114.

At 114, the processor 30 determines if the credential was ever authorized to open the lock 16. Block 114 is intended to accommodate a situation, for example, where a guest has checked out of a hotel, rendering the credential expired, but the guest has returned to their room, perhaps to retrieve a forgotten item. This situation should be distinguished from an intruder. Block 114 may be performed by comparing the credential to one or more prior lock credentials (e.g., lock credentials stored within the past X days) stored in the memory 32. If the credential matches a prior lock credential, then the processor 30 determines that the credential was previously valid. Additionally, the credential may have encoded on it a start/end date for the credential. These dates can be examined to see if the credential was recently expired. Additionally, the credential may contain a data parameter that can be compared with the data stored in the lock 16. If they match or are a close match, then the lock 16 determines this credential was recently authorized to access this lock 16, but now is not authorized to access this lock 16 because of the expired date. At 115, an audit event may be sent to the lock server 2 indicating that the credential could not open the lock 16, but the credential was previously authorized to access this lock 16. The process returns to 110.

In other embodiments, the comparing the credential to one or more prior credentials includes comparing a numerical sequence of the lock credential to the numerical sequence of the credential. If the numerical sequence of the lock credential and the numerical sequence of the credential are within a certain threshold (e.g., 10) or share a common prefix of suffix, then the processor 30 determines that the credential was previously valid, no event is generated and flow returns to 110.

If at 114, the credential was not ever authorized to open the lock 16, flow proceeds to 116 where the processor 30 generates a security event and sends the event to the lock server 2 over the network 4. A security event identifies an access attempt that may pose a security threat. The event may include event data specific to the access attempt, including one or more of the lock identifier of the lock 16, a timestamp indicating when the access attempt occurred, the credential used to attempt to open the lock 16, the lock credential, an identifier of the card, etc.

At 118, the lock server 2 receives the event, stores the event (along with the event data) and determines if an alert needs to be generated. The lock server 2 applies one or more event factors 210 (FIG. 4) to evaluate if an alert should be generated, as described herein with reference to FIG. 4. If the lock server 2 determines that an alert is not warranted, flow proceeds back to 110. If the lock server 2 determines that an alert is warranted, flow proceeds to 120 where an alert is sent to the monitoring system 6. The process then returns to block 110 for further monitoring.

After an alert is sent to the monitoring system 6, one or more corrective actions may be initiated at 122. The monitoring system 6 may issue a broadcast message to all the locks 16 that the credential associated with the alert is to be disabled. This may also include the locks 16 updating the lock credential in memory 32 and generating new credentials for an authorized user of the disabled credential. This would involve retrieving a blank card and encoding it with the new credential for the authorized user so that the new card is ready for them. This could be an associate at the front desk of a hotel encodes the new credential, so that when the guest comes to the front desk, their new card is ready for them as a courtesy. The guest may be automatically notified that the new card is available. A message may also be sent to the authorized user of the disabled credential indicating that their existing credential has been disabled for security purposes and they will need to obtain a new credential.

Figure 4:
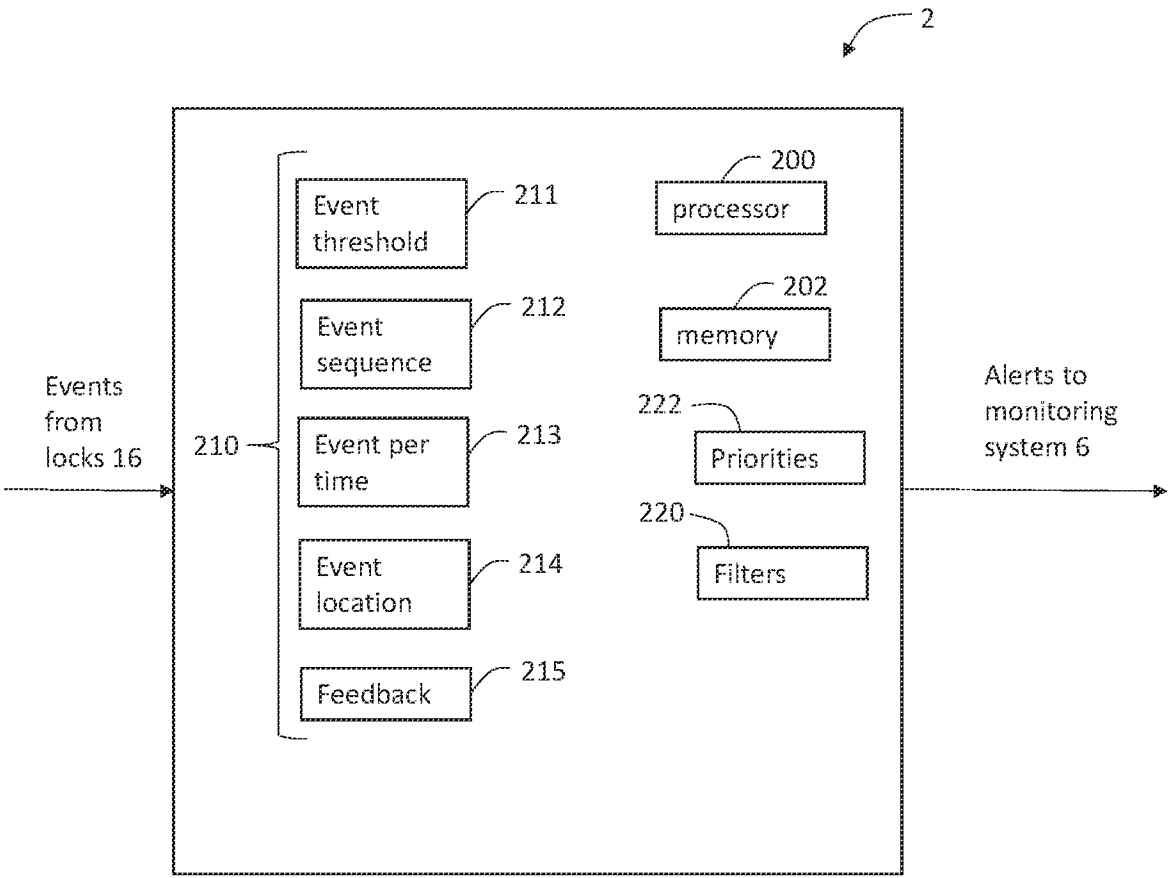
FIG. 4 depicts a lock server in an example embodiment.

FIG. 4 depicts the lock server 2 in an example embodiment. The lock server 2 includes a processor 200 and memory 202. The processor 200 may, for instance, be a microprocessor that can process instructions to process the events from the locks 16 and generate an alert to the monitoring system 6. The memory 202 may be RAM, EEPROM, or other storage medium where the processor 200 can read and write data including but not limited to events including event data, alerts, etc.

In operation, the lock server 2 processes events from the locks 16 and determines if an alert should be sent to the monitoring system 6. The lock server 2 may use machine intelligence to dynamically adjust when alerts are generated. Such techniques may include, but are not limited to, nearest neighbor (NN) techniques (e.g., k-NN models, replicator NN models, etc.), statistical techniques (e.g., Bayesian networks, etc.), clustering techniques (e.g., k-means, mean-shift, etc.), neural networks (e.g., reservoir networks, artificial neural networks, etc.), support vector machines (SVMs), logistic or other regression, Markov models or chains, principal component analysis (PCA) (e.g., for linear models), multi-layer perceptron (MLP) ANNs (e.g., for non-linear models), replicating reservoir networks (e.g., for non-linear models, typically for time series), random forest classification, or the like. In this manner, the lock server 2 can reduce the occurrence of false or nuisance alerts sent to the monitoring system 6.

The lock server 2 processes the events based on one or more event factors 210. The event factors 210 may be considered alone or in any combination in order to determine if an alert should be generated. An event threshold factor 211 is used to determine if a credential has been associated with a certain number of events. For example, if a credential is used 10 times in unsuccessful access attempts (regardless of location or time period), this may indicate that an alert should be generated.

An event sequence factor 212 is used to determine if the credential has been associated with unsuccessful access attempts in a series of locations. For example, an intruder may walk down a hallway of a hotel attempting to access each lock 16 in sequence. The event sequence factor 212 may define that an alert should be generated if the credential is associated with, for example, 5 sequential (e.g., adjacent locks) unsuccessful access attempts.

An event per time factor 213 is used to determine if the credential has been associated with unsuccessful access attempts over a period time (e.g., a half hour). An intruder would typically have a much higher rate of unsuccessful access attempts over a period time than a current hotel guest. The event per time factor 213 may define that an alert should be generated if the unsuccessful access attempts over a period time exceeds a threshold (e.g., 8 unsuccessful access attempts over 20 minutes).

An event location factor 214 takes into account the location of the unsuccessful access attempt. For example, a guest may simply be on the wrong floor of the hotel and has mistaken their room as 201, instead of the correct room 101. The event location factor 214 may be used to disregard such unsuccessful access attempts.

A feedback factor 215 is used to adjust when an alert is generated based on feedback received, for example, from the monitoring system 6. As noted above, the lock server 2 may employ machine intelligence to dynamically adjust when alerts are generated. The feedback factor 215 can adjust the machine learning algorithms as needed. The feedback factor 215 can be used to increase or decrease the likelihood of generating an alert based on feedback received from the monitoring system 6. For example, guests may often mistakenly try to access a VIP section of a hotel, not being aware that this section of the hotel requires a VIP credential. The feedback factor 215 may be used to reduce or eliminate alerts based on unsuccessful access attempts that are likely nuisance attempts, rather than an actual intruder.

Once the lock server 2 determines that an alert should be generated based on the event factors 210, the lock server 2 generates an alert. The alert may contain alert data such as one or more of the lock identifier of the lock(s) 16, a timestamp indicating when the access attempt(s) occurred, the credential used, the lock credential(s), etc. The lock server 2 may filter alerts based on filter parameters 220, established by user(s) of the monitoring system 6. For example, an administrator of the monitoring system 6 may request that alerts related to the VIP section of the hotel should not be sent to the monitoring system 6. The alert may still be stored in memory 202, for subsequent review, but the alert is not sent to the monitoring system 6.

The lock server 2 may also prioritize alerts base on priority parameters 222, established by user(s) of the monitoring system 6. For example, an administrator of the monitoring system 6 may request that alerts related to unsuccessful access attempts along a sequential path of the locks 16 be identified as high priority, as this factor is highly indicative of a wandering intruder. The alerts may be presented to the monitoring system 6 in order of descending priority, color-coded, etc.

Embodiments provide the ability to detect events at locks and determine if an alert should be generated in response to the events. The lock monitoring may detect an intruder in an environment, such as a hotel, but reduce the likelihood of false alerts by applying machine intelligence to the generation of alerts.

As described above, embodiments can be in the form of processor-implemented processes and devices for practicing those processes, such as processor 30 or processor 200. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiments disclosed as the best mode contemplated for carrying out this present disclosure, but that the present disclosure will include all embodiments falling within the scope of the claims.

What is claimed is:

1. A method for reporting activity at a lock, the method comprising:

detecting an access attempt at the lock in response to a credential presented at the lock;

determining if a security event is to be generated in response to the access attempt;

upon generation of the security event, determining if an alert is to be generated in response to the security event;

wherein determining if the security event is to be generated comprises not generating the security event in response to the access attempt not opening the lock and the credential previously being authorized to open the lock; and generating an audit event in response to the access attempt not opening the lock and the credential previously being authorized to open the lock.

2. The method of claim 1 wherein determining if the security event is to be generated comprises not generating the security event in response to the access attempt opening the lock.

3. The method of claim 1 wherein determining if the security event is to be generated comprises generating the security event in response to the access attempt not opening the lock and the credential not previously being authorized to open the lock.

4. The method of claim 1 wherein determining if the alert is to be generated in response to the security event comprises applying one or more event factors to the security event.

5. The method of claim 4 wherein, the one or more event factors comprises an event threshold factor, wherein the alert is generated in response to a number of security events exceeding the event threshold factor.

6. The method of claim 4 wherein, the one or more event factors comprises an event sequence factor, wherein the alert is generated in response to a number of security events occurring in a sequence.

7. The method of claim 4 wherein, the one or more event factors comprises an event per time factor, wherein the alert is generated in response to a number of security events exceeding the event per time factor.

8. The method of claim 4 wherein, the one or more event factors comprises an event location factor, wherein the alert is generated in response to a location of the security event with respect to the event location factor.

9. The method of claim 4 wherein, the one or more event factors comprises a feedback factor, wherein the alert is generated in response to the feedback factor.

10. The method of claim 1 further comprising:

upon determining that the alert is to be generated, transmitting the alert to a monitoring system.

11. The method of claim 10 further comprising;

prioritizing alerts prior to transmission to the monitoring system.

12. The method of claim 10 further comprising;

filtering alerts prior to transmission to the monitoring system.

13. A system comprising:

a lock configured to detect an access attempt at the lock in response to a credential presented at the lock;

the lock configured to determine if a security event is to be generated in response to the access attempt;

a lock server in communication with the lock;

upon generation of the security event, the lock server configured to determine if an alert is to be generated in response to the security event, wherein the lock determining if the security event is to be generated comprises not generating the security event in response to the access attempt not opening the lock and the credential previously being authorized to open the lock;

the lock generating an audit event in response to the access attempt not opening the lock and the credential previously being authorized to open the lock.

14. A computer program product for reporting activity at a lock, the computer program product comprising a non-transitory computer readable storage medium having program instructions embodied therewith, the program instructions executable by a processor to cause the processor to implement operations comprising:

detecting an access attempt at the lock in response to a credential presented at the lock;

determining if a security event is to be generated in response to the access attempt;

upon generation of the security event, determining if an alert is to be generated in response to the security event, wherein determining if the security event is to be generated comprises not generating the security event in response to the access attempt not opening the lock and the credential previously being authorized to open the lock;

generating an audit event in response to the access attempt not opening the lock and the credential previously being authorized to open the lock.

15. A method for reporting activity at a lock, the method comprising:

detecting an access attempt at the lock in response to a credential presented at the lock;

determining if a security event is to be generated in response to the access attempt;

upon generation of the security event, determining if an alert is to be generated in response to the security event;

wherein determining if the security event is to be generated comprises not generating the security event in response to the access attempt not opening the lock and the credential previously being authorized to open the lock and the credential being currently expired.

* * * * *